US008397344B2

(12) United States Patent
Liddell

(10) Patent No.: US 8,397,344 B2
(45) Date of Patent: Mar. 19, 2013

(54) CLEANING APPLIANCE

(75) Inventor: Sarah Helen Liddell, Malmesbury (GB)

(73) Assignee: Dyson Technology Limited, Malmesbury (GB)

( * ) Notice: Subject to any disclaimer, the term of this patent is extended or adjusted under 35 U.S.C. 154(b) by 431 days.

(21) Appl. No.: 12/709,150

(22) Filed: Feb. 19, 2010

(65) Prior Publication Data

US 2010/0223751 A1 Sep. 9, 2010

(30) Foreign Application Priority Data

Mar. 3, 2009 (GB) ..... 0903587.4

(51) Int. Cl.
*A47L 5/00* (2006.01)
*A47L 5/24* (2006.01)

(52) U.S. Cl. ..... 15/326; 15/344

(58) Field of Classification Search ..... 15/326, 15/344; *A47L 5/00, 5/24*
See application file for complete search history.

(56) References Cited

U.S. PATENT DOCUMENTS

| | | | | |
|---|---|---|---|---|
| 4,970,753 | A | 11/1990 | Herron, Jr. | |
| 6,530,452 | B1 | 3/2003 | Pettersson et al. | |
| 2001/0052165 | A1 | 12/2001 | Anderson et al. | |
| 2002/0108211 | A1 * | 8/2002 | Svoboda | 15/405 |
| 2002/0138941 | A1 * | 10/2002 | Paterson et al. | 15/412 |
| 2004/0083572 | A1 * | 5/2004 | Song | 15/347 |
| 2005/0138756 | A1 * | 6/2005 | Lee | 15/326 |
| 2006/0260091 | A1 | 11/2006 | Song et al. | |
| 2007/0050939 | A1 * | 3/2007 | Dant et al. | 15/347 |

FOREIGN PATENT DOCUMENTS

| | | |
|---|---|---|
| CN | 101051772 | 10/2007 |
| CN | 101204302 | 6/2008 |
| DE | 1 964 475 | 7/1971 |
| DE | 102 21 443 | 12/2003 |
| EP | 1 790 264 | 5/2007 |
| EP | 1 842 473 | 10/2007 |
| GB | 810 447 | 3/1959 |
| GB | 1 207 278 | 9/1970 |
| JP | 56-64761 | 5/1981 |
| JP | 2002-525697 | 8/2002 |
| WO | WO-03/068042 | 8/2003 |

OTHER PUBLICATIONS

Translation of Kern (DE 102 21 443) from Espacenet.com—The European Patent Office online translator.*
British Search Report dated May 15, 2009, directed to counterpart GB Application No. 0903587.4; 1 page.
International Search Report and Written Opinion mailed on Jun. 18, 2010 directed to PCT/GB2010/050258; 15 pages.

* cited by examiner

*Primary Examiner* — Brian Glessner
*Assistant Examiner* — Brian D Mattei
(74) *Attorney, Agent, or Firm* — Morrison & Foerster LLP

(57) ABSTRACT

A cleaning appliance includes an airflow generator for generating an airflow, separating apparatus for separating dirt and dust from the airflow, a power source for supplying power to the airflow generator, at least one exhaust vent and an exhaust baffle, the exhaust baffle includes a body having an upstream face and a downstream face, an airflow path between the upstream and downstream faces and a plurality of blades projecting from the body, each blade having a first side edge, a second side edge and a forward edge.

6 Claims, 9 Drawing Sheets

CLEANING APPLIANCE

REFERENCE TO RELATED APPLICATIONS

This application claims the priority of United Kingdom Application No. 0903587.4 filed Mar. 3, 2009, the entire contents of which are incorporated herein by reference.

FIELD OF THE INVENTION

The invention relates to a cleaning appliance comprising an exhaust baffle. Particularly, but not exclusively, the invention relates to an exhaust baffle for a handheld vacuum cleaner.

BACKGROUND OF THE INVENTION

Handheld vacuum cleaners are well known and have been manufactured and sold for several years. Typically, a handheld vacuum cleaner comprises a body which houses a motor and a fan unit for generating an airflow. The airflow enters the vacuum cleaner via an inlet. A separator such as a filter, bag or cyclonic separator is located downstream of the inlet to separate dirt and dust from the airflow. An example of this type of vacuum cleaner is shown in GB 1 207 278.

Handheld vacuum cleaners are generally powered by brushed carbon motors, and therefore it is common to have a post motor filter in order to catch carbon released from the brushes of the motor. Such a filter also advantageously reduces the noise of the vacuum cleaner during use.

Although brushed carbon motors are adequate, there has been a desire to increase the power of the motor to improve the performance of vacuum cleaners. In order to achieve this brushless DC motors are now being used. Brushless DC motors are more powerful and smaller than conventional motors and no longer require the use of post motor filters because no carbon is produced. As stated above a post motor filter reduces noise and therefore if it is not present, another noise reducing device would be desirable.

In addition, it is generally desirable for cleaning appliances to be as quite as possible during use. Therefore any new sound reducing mechanism in a cleaning appliance would be desirable.

SUMMARY OF THE INVENTION

Accordingly, a first aspect of the present invention provides a cleaning appliance comprising an airflow generator for generating an airflow, separating apparatus for separating dirt and dust from the airflow, a power source for supplying power to the airflow generator, at least one exhaust vent and an exhaust baffle, the exhaust baffle comprising a body having an upstream face and a downstream face, an airflow path between the upstream and downstream faces and a plurality of blades projecting from the body, each blade having a first side edge, a second side edge and a forward edge.

In a preferred embodiment the cleaning appliance is a vacuum cleaner, for example a handheld vacuum cleaner.

This arrangement is advantageous as the exhaust baffle increases the distance that air has to travel through the cleaning appliance. In a particular embodiment the exhaust baffle may be arranged downstream of the airflow generator and upstream of the exhaust vent(s), preferably it may also be physically located between the airflow generator and the exhaust vent(s). In a particular embodiment the body is planer or substantially planar in shape.

Such an arrangement may be advantageous in a cleaning appliance because most noise is generated by the airflow generator. Airflow exiting the airflow generator has to travel past the blades of the exhaust baffle. This increases the length of the air path through the cleaning appliance and therefore helps to reduce noise.

Ideally at least one of the blades blocks a line of sight between the airflow generator and one or more exhaust vent (s). This advantageously further reduces noise levels. The blades may be located on the downstream or the upstream faces of the body. In a particular embodiment one or more blades may be provided on both the upstream and the downstream faces of the body. In a preferred embodiment a plurality of blades are provided on the downstream face of the body.

In a particular embodiment one or more of the exhaust vents may be louvered. This provides a further lengthening of the air path and further helps to stop the line of sight between the airflow generator and the exhaust vents.

The airflow generator may be a brushed carbon motor but in a preferred embodiment it may be a brushless DC motor. The present invention provides advantageous noise reduction in such a cleaning appliance because brushless DC motors do not require post motor filters and therefore do not benefit from the noise absorbing properties of standard post motor filters.

In a particular embodiment at least one exhaust vent may be located on a removable casing of the cleaning appliance and the exhaust baffle may be removably located at least partially within the casing. Preferably the exhaust vent(s) is located on the removable casing.

In a preferred embodiment the vent(s) is located on an area of the casing which corresponds with the blades of the exhaust baffle, such that during use air may flow past the blades and out through the exhaust vent(s).

In a particular arrangement the casing may be substantially cup shaped in that it may have a perimeter wall and an end face. In a preferred embodiment the exhaust vent(s) may be located on the wall of the casing. In a particular arrangement a plurality of exhaust vents may be regularly spaced around the wall, alternatively a single vent or groups of vents may be dispersed around the wall. Alternatively there may be a plurality of randomly spaced vents.

Engagement means may be provided between the exhaust baffle and the casing. This may advantageously help to keep the exhaust baffle located at least partially within the casing. Any part of the exhaust baffle which is not located in the casing may be located in a part of the cleaning appliance housing to which the casing may be releasably attachable.

The engagement means may comprise any suitable means, for example a snap-fit engagement means. In such an embodiment one or more protrusions may be provided on the exhaust baffle and one or more protrusion accepting notches may be present on an inner surface of the casing, for example an inner surface of the perimeter wall. Alternatively one or more protrusions may be provided on the inner surface of the casing, for example an inner surface of the perimeter wall and one or more protrusion accepting notches may be present on the exhaust baffle.

It is desirable that there is an interface fit between the forward edges of the blades and an inner surface of the casing, the airflow generator and/or a housing of the airflow generator depending on which face of the body the blades are projecting from. This may advantageously help to ensure that substantially all and preferably all of the air exiting the airflow generator flows past the blades rather than over them. In a particular arrangement this may be achieved by having a groove, for example a V-shaped groove on the surface of one or more and preferably all of the forward edges of the blades.

In such an embodiment it is desirable that an inner surface of the casing and/or airflow generator or its housing, for example an inner surface of the end face of the casing has corresponding projections which are shaped to fit into the groove(s) on the forward edge(s) of the blade(s) to provide an interface fit between them. It is of course possible, for example, to have the groove(s) on the inner surface of the casing and the corresponding projection(s) on the forward face(s) of the blade(s). In a preferred embodiment all of the blades are in an interference fit with the inner surface of the end face of the casing.

Preferably a skirt extends from an outer edge of the upstream face of the body. Such a skirt may be arranged to engage with the airflow generator, the casing or the housing of the airflow generator to provide an airtight or substantially airtight seal, such that during use substantially all or all of the airflow exhausting from the airflow generator flows through the airflow path towards the exhaust vent(s). In a particular embodiment the skirt is formed from a flexible material for example PP, Nylon or rubber. Suitably, the entire exhaust baffle may be formed from such a material.

In a particular embodiment the power source may be a battery pack. Alternatively the power source may be a mains cable for connecting the cleaning appliance to a source of mains power.

A cyclonic separating unit need not be used. Other separating apparatus such as a bag-type filter could be used. Other types of cleaning appliances could be used, for example, upright or cylinder cleaning appliances, carpet shampooers, wet and dry machines or blower vacuum devices.

According to a second aspect of the present invention there is provided an exhaust baffle for a cleaning appliance comprising, a body having an upstream face and a downstream face, an airflow path between the upstream and downstream faces, and a plurality of blades projecting from the body, each blade having a first side edge, a second side edge and a forward edge. Preferably the airflow path is an aperture formed through the body, from the upstream face to the downstream face. In a particular embodiment the body is a planar or substantially planar body. The blades may project from the upstream and/or the downstream face of the body.

Ideally an engagement means may be provided for allowing engagement with a cleaning appliance or a component thereof. Such an engagement means may comprise for example one half of a snap-fit engagement means. Such a snap-fit engagement means is preferably designed to engage with a second half of the snap-fit arrangement provided on a cleaning appliance or a component thereof. In a preferred embodiment the first half of the snap fit engagement means may comprise one or more protrusions. Ideally the protrusion (s) is elongate.

Preferably the exhaust baffle further comprises a skirt extending from an outer edge of the upstream face of the body. In a particular embodiment the first half of the snap-fit engagement means may be located on an outer surface of the skirt.

In a particular embodiment a forward edge of at least one of the blades may be shaped to engage with a cleaning appliance or a component thereof. Ideally the forward edge of at least one blade may be V-shaped or U shaped.

The first side edge of at least one blade may be located near or at an edge of the airflow path and the second side edge of the blade may be located at or near an outer edge of the body. Preferably the first side edge of each blade may be located near or at an edge of the airflow path and the second side edge of each blade may be located at or near the outer edge of the body. In a particular embodiment each blade may be curved along its length and/or spiral outwardly towards the outer edge of the body. The blades may therefore form a plurality of passageways which curve towards the airflow path from the airflow generator or from the airflow path towards the exhaust vent(s) depending on whether the blades are projecting from the upstream or the downstream face of the body.

One or more of the blades may decrease in thickness along its length from its first side edge to its second side edge. Ideally all of the blades decrease in thickness along their length from their first side edges to their second side edges. This advantageously may make the blades more aerodynamic thus helping to decrease noise levels further.

The body may be of any suitable shape. Preferably the body is substantially planer. Ideally the planar body may be circular or substantially circular in shape. In a particular embodiment the blades may be arranged around a circumference of the body. The first and second side edges of adjacent blades may overlap. Where the first and second side edges overlap they are preferably spaced apart along a radius of the planar body.

BRIEF DESCRIPTION OF THE DRAWINGS

Embodiments of the invention will now be described with reference to the accompanying drawings, in which.

DETAILED DESCRIPTION OF THE INVENTION

Figure 1:
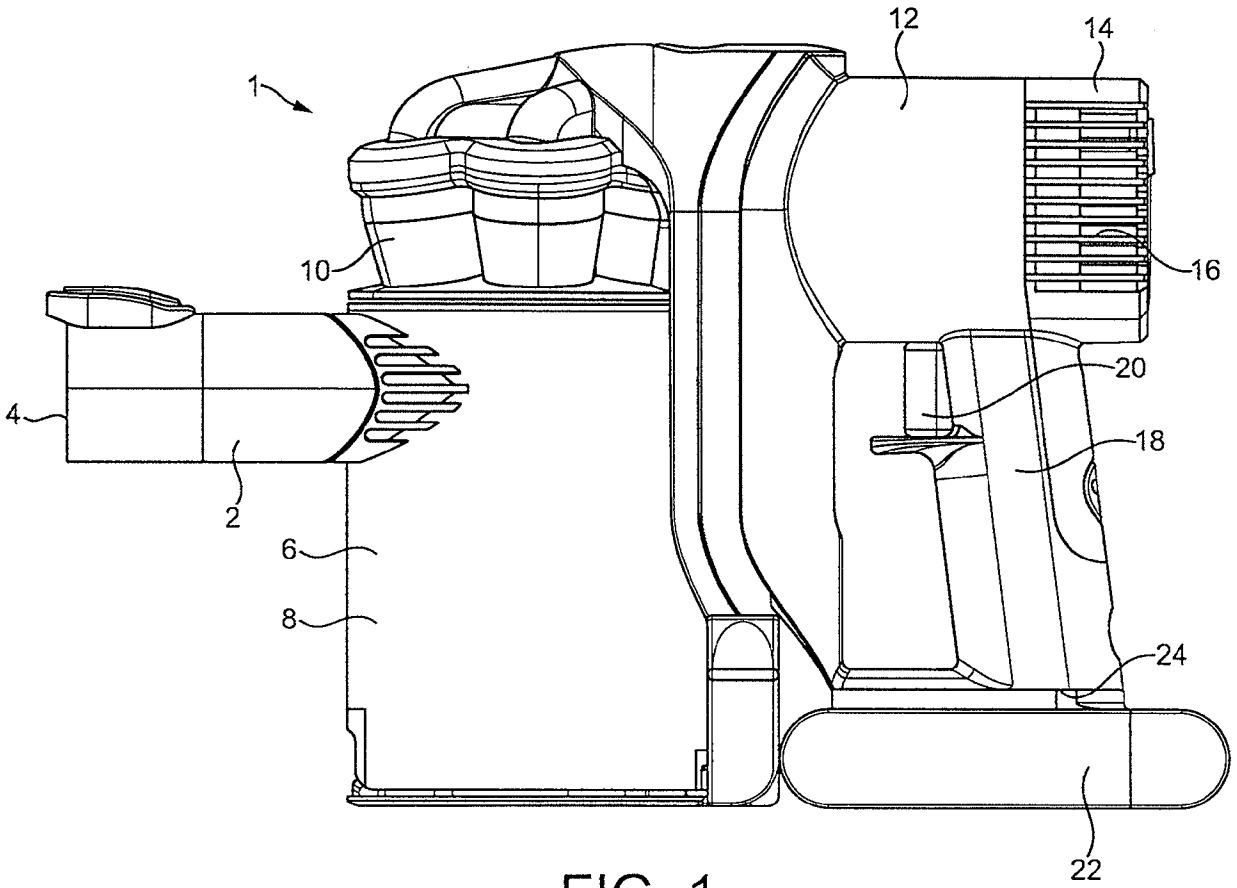
FIG. 1 is a side view of a handheld cleaning appliance according to a first aspect of the present invention.

FIG. 1 shows a hand-held vacuum cleaner 1. The hand-held vacuum cleaner 1 comprises a suction conduit 2 having a suction opening 4. The vacuum cleaner 1 also includes cyclonic separating apparatus 6 for separating dirt and dust from an airflow drawn in through the suction opening 4. The cyclonic separating apparatus 6 is in communication with the suction conduit 2 and the suction opening 4. The cyclonic separating apparatus 6 comprises an upstream cyclone 8 and a plurality of downstream cyclones 10.

The vacuum cleaner 1 further includes a motor housing 12 and a removable casing 14 having a plurality of exhaust vents 16 formed therein. An air flow path extends from the suction opening 4, through the suction conduit 2, the cyclonic separating apparatus 6 and the motor housing 12 to the exhaust vents 16. A handgrip 18 is located below the motor housing 12 for manipulating the hand-held vacuum cleaner 1 when in use. The handgrip 18 is arranged so that the cyclonic separating apparatus 6 is located between the handgrip 18 and the suction opening 4. The handgrip 18 includes a trigger switch 20 which is positioned on the side of the handgrip 18 closest to the suction opening 4 such that the trigger switch 20 can be manipulated by a user's index finger. A power source 22 in the form of a lithium ion battery pack is connected to the handgrip 18 through a mounting portion 24.

Figure 2:
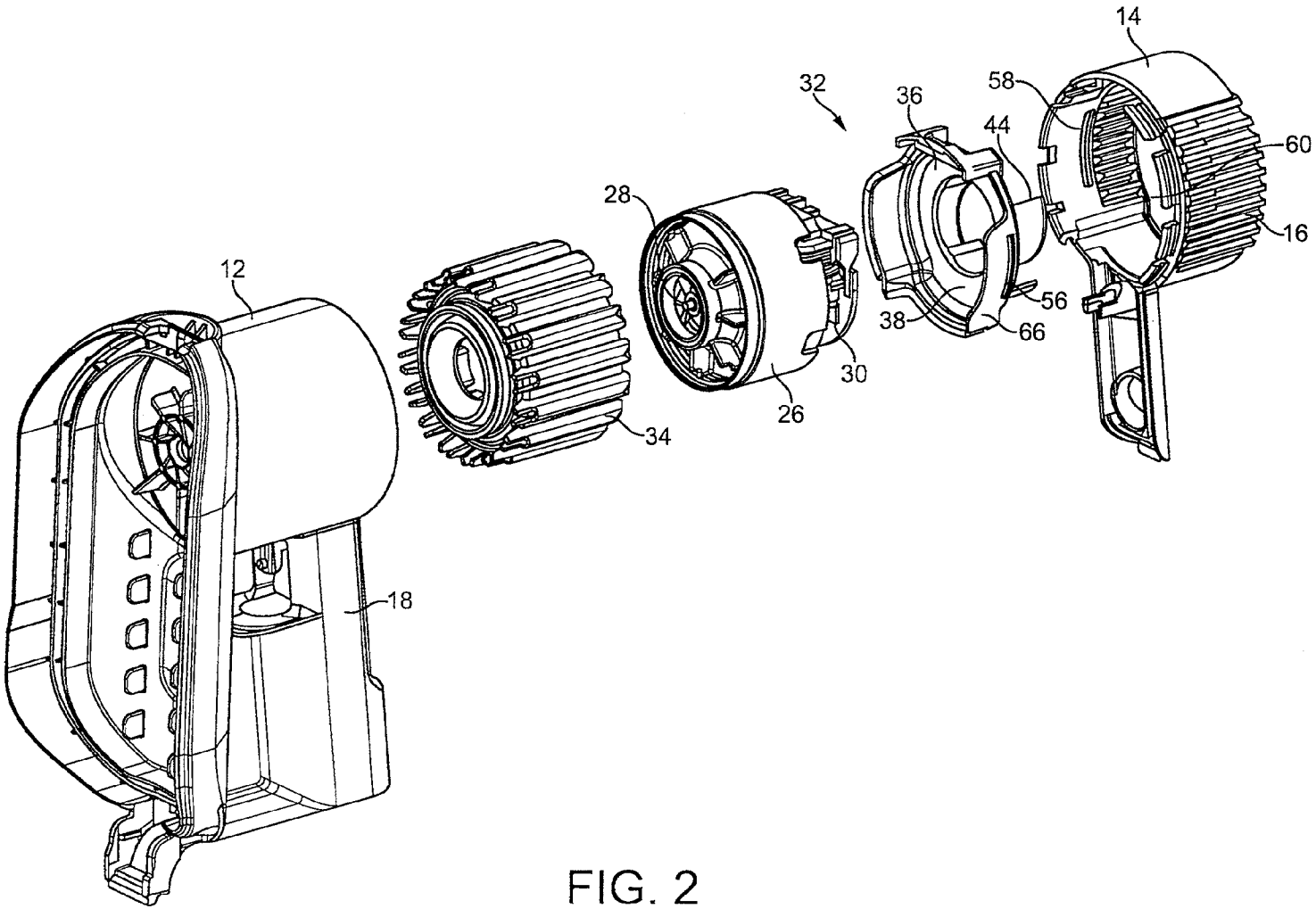
FIG. 2 is an exploded view of the motor housing of the hand-held vacuum cleaner shown in FIG. 1.
Figure 3:
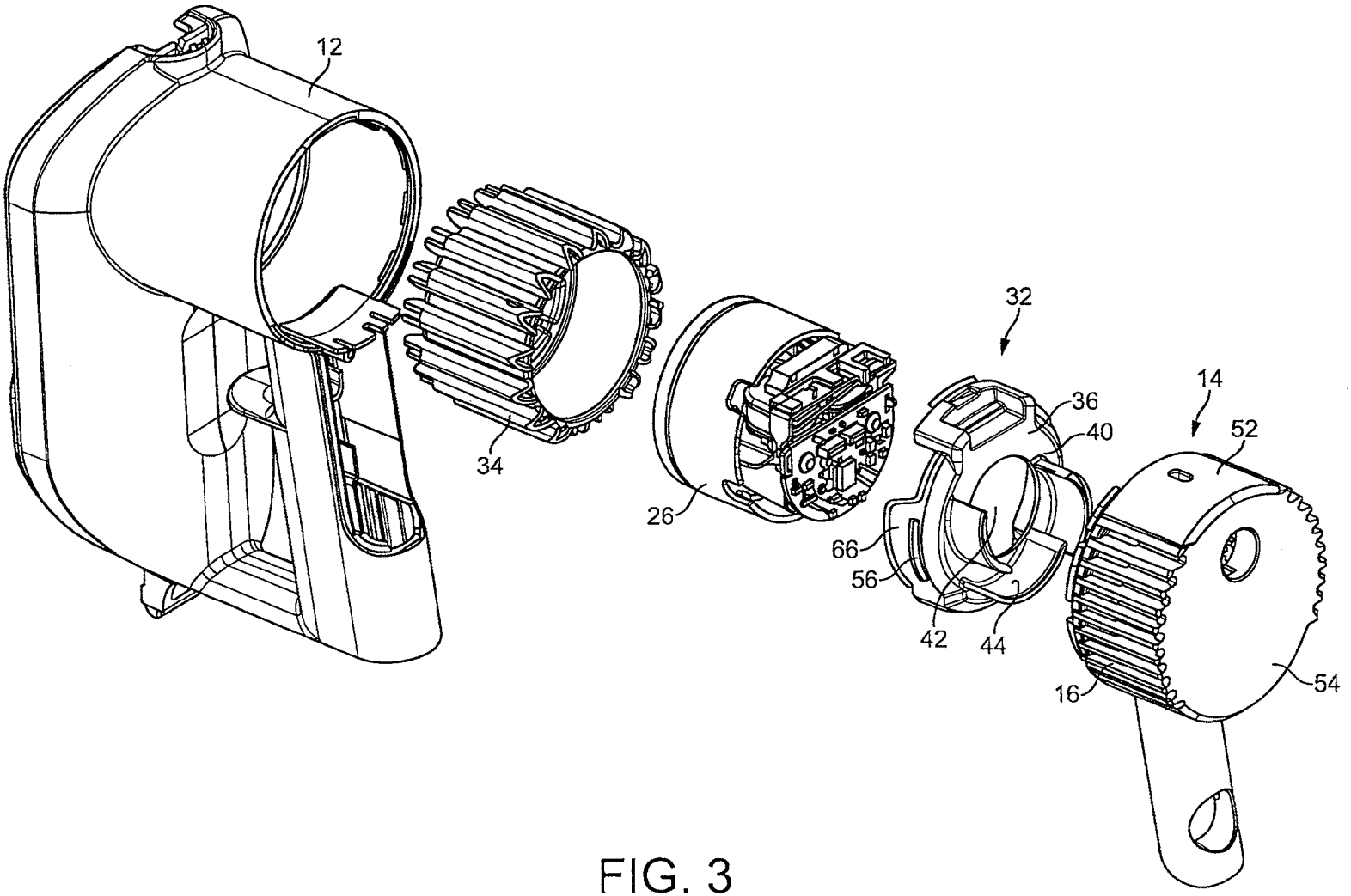
FIG. 3 is an exploded view of the motor housing of the hand-held vacuum cleaner shown in FIG. 1, FIG. 4 and FIG. 5 are perspective views of an exhaust baffle having a plurality of blades projecting from the downstream face of the body in accordance with the second aspect of the present invention.
Figure 7B:
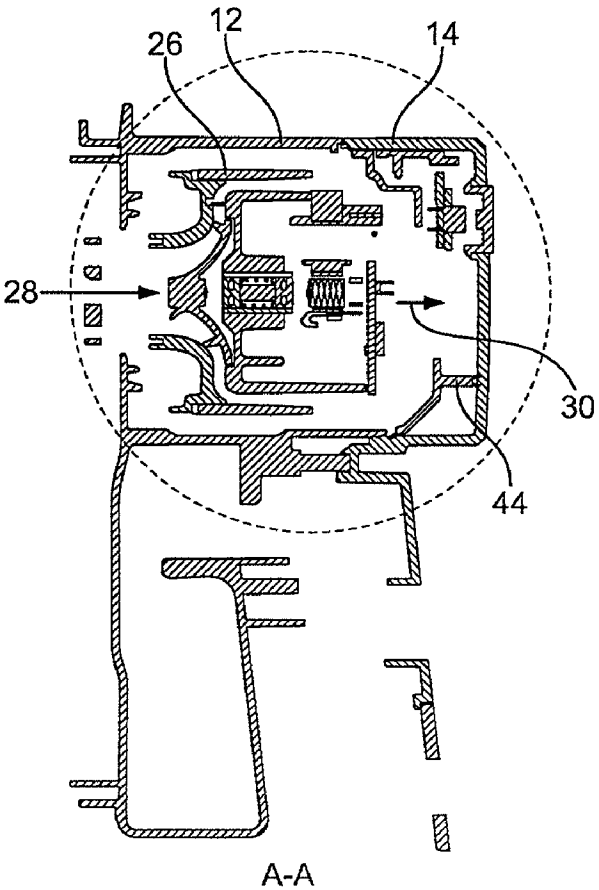
FIG. 7*b* is a section through line A-A shown in FIG. 7*a*.
Figure 7A:
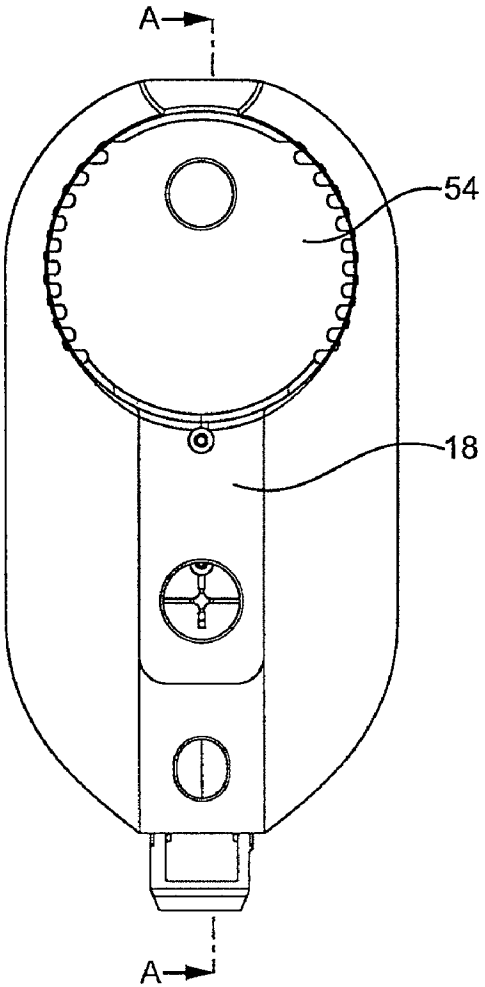
FIG. 7*a* is a rear view of casing of the hand held vacuum cleaner shown in FIG. 1.
Figure 7C:
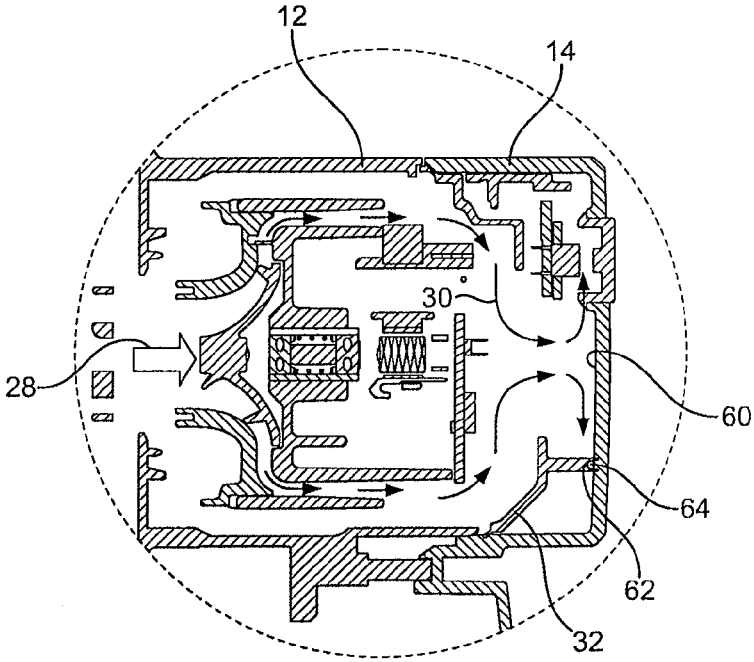
FIG. 7*c* is a close up view of the circled area shown in FIG. 7*b*, FIG. 8 and FIG. 9 are perspective views of an alternative embodiment of an exhaust baffle having a plurality of blades projecting from the upstream face of the body in accordance with the second aspect of the present invention.

In FIGS. 2 and 3 it can be seen that an airflow generator 26 is located in the motor housing 12. In this embodiment, the airflow generator 26 takes the form of a brushless DC motor and fan assembly. The airflow generator 26 has an inlet 28 and an outlet 30. The inlet 28 and outlet 30 can be seen more clearly in the airflow diagram shown in FIG. 7. A pre-motor filter (not shown) may be located upstream of the inlet 28 for filtering fine particulates from the airflow. An exhaust baffle 32 is located downstream of the outlet 30. The pre-motor filter if present and the exhaust baffle 32 are located in the air path through the vacuum cleaner 1.

A mount 34 may also be provided to support the airflow generator 26 inside the motor housing 12. The mount 34 may be formed from any suitable material but is preferably made from a soft material such as rubber, which provides cushioning between the airflow generator 26 and the motor housing 12. This advantageously helps to reduce the overall sound emitted by the vacuum cleaner 1 during use.

When operating, the airflow generator 26 draws a flow of dirt- and dust-laden air into the suction opening 4, through the suction conduit 2 and into the cyclonic separating apparatus 6. The cleaned air exits the cyclonic separating apparatus 6 and passes sequentially through a pre-motor filter if present, the airflow generator 26 and the exhaust baffle 32 before being exhausted through the exhaust vents 16.

Figure 5:
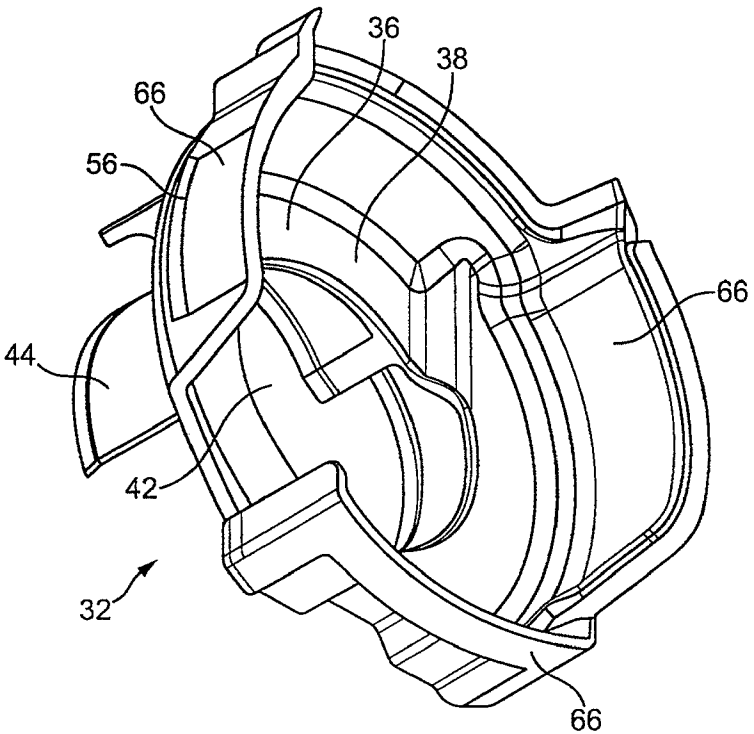
Figure 4:
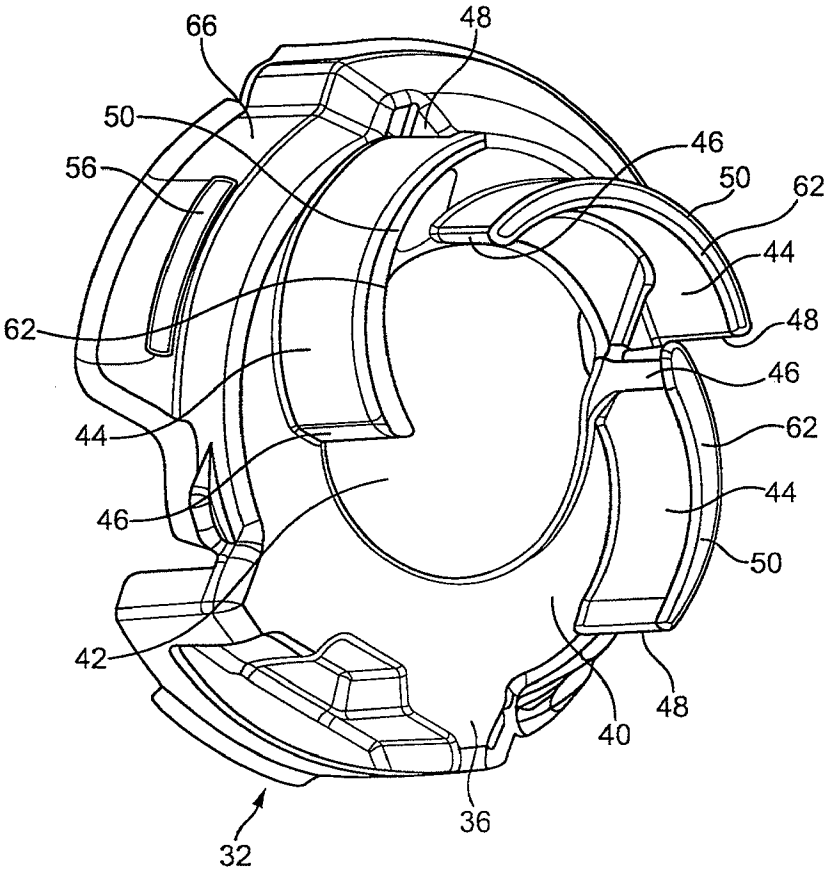

The exhaust baffle 32 can be seen in more detail in FIGS. 4 and 5. The exhaust baffle 32 comprises a substantially planar body 36 having an upstream face 38 and a downstream face 40, an airflow path 42 between the upstream and downstream faces 38, 40 and a plurality of blades 44 projecting from the downstream face 40, each blade 44 having a first side edge 46, a second side edge 48 and a forward edge 50.

In the embodiments shown in the Figures the exhaust baffle 32 is arranged downstream of the airflow generator 26 and upstream of the exhaust vents 16. The exhaust baffle 32 is also physically located between the airflow generator 26 and the exhaust vents 16.

Figure 6B:
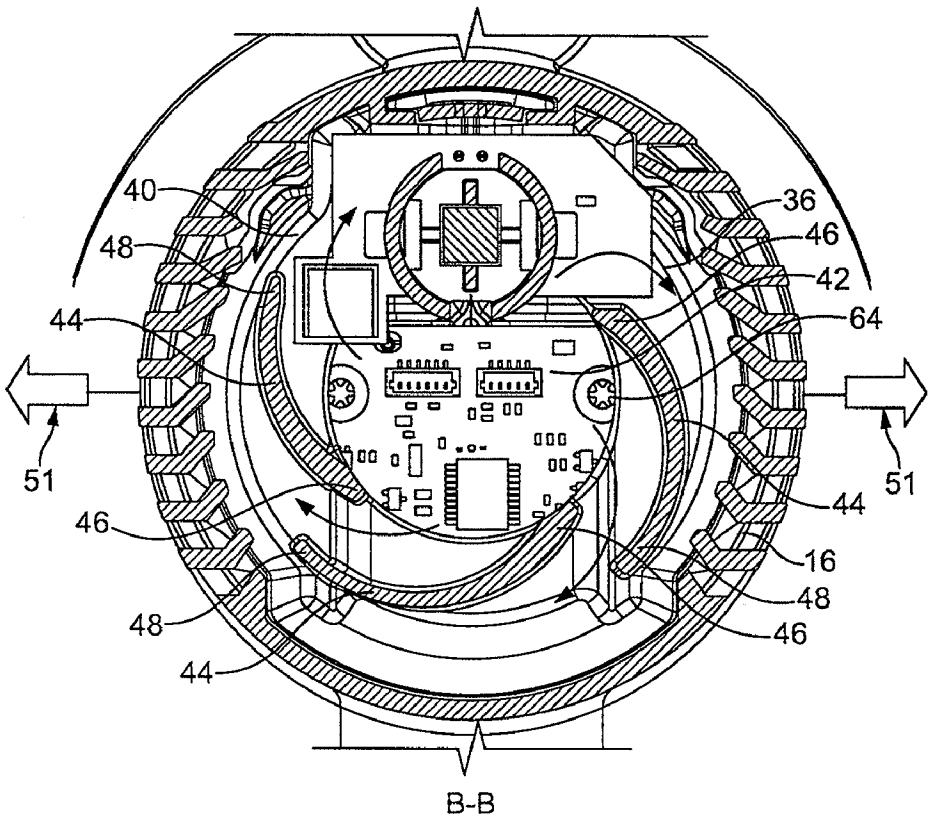
FIG. 6*b* is a section through line B-B shown in FIG. 6*a*.
Figure 6A:
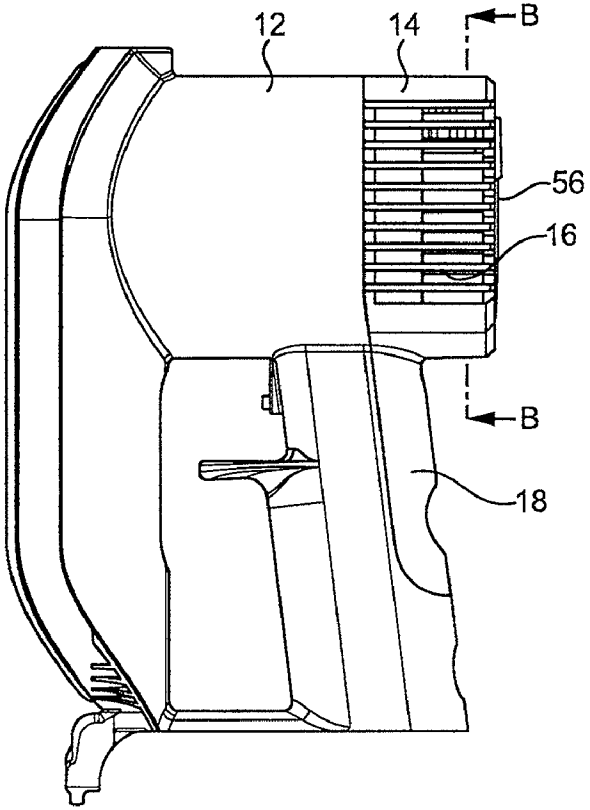
FIG. 6*a* is a side view of the motor housing of the hand held vacuum cleaner shown in FIG. 1.

In the embodiment shown in FIG. 6*b* it can be seen that at least one of the blades 44 blocks the line of sight between the airflow generator 26 and at least one of the exhaust vents 16 such that the air has to follow a curved path as it moves past the blades 44 towards the exhaust vents 16. The exiting air can be seen by the arrows numbered 51. In the particular embodiment shown in FIG. 6*b* the exhaust vents 16 are louvered. This provides a further lengthening of the air path through the vacuum cleaner 1 and further helps to stop the line of sight between the airflow generator 26 and the exhaust vents 16.

The exhaust baffle 32 is removably located within the casing 14. In the embodiment shown in the Figures the casing 14 is substantially cup shaped, having a perimeter wall 52 and an end face 54 (See FIG. 3 for the best view). In the embodiment shown the exhaust vents 16 are regularly spaced around the wall 52, although there are some areas of the wall 52 which are vent free.

Snap fit engagement means are provided between the exhaust baffle 32 and the casing 14. A pair of protrusions 56 are provided on the exhaust baffle 32 and a corresponding pair of protrusion accepting notches 58 (see FIG. 2) are present on an inner surface of the casing 14.

In FIGS. 2 to 7*c*, in order to ensure that substantially and preferably all of the air passing through the airflow path 42 flows past the blades 44 rather than over them an interface fit is provided between the forward edges 50 of the blades 44 and an inner surface 60 of the end face 54 of the casing 14. In the arrangement shown in FIGS. 7*a* to 7*c* this is achieved by having a groove 62, for example a V-shaped groove 62 on the forward edges 50 of the blades 44. The inner surface 60 of the end face 54 of the casing 14 has corresponding projections 64 which are shaped to fit into the grooves 62 on the forward edges 50 of the blades 44 to provide the interface fit.

A skirt 66 extends from an outer edge of the upstream face 38 of the planar body 36. The skirt 66 is arranged to engage with the casing 14 to provide a substantially airtight seal, such that during use substantially all or all of the airflow exhausting from the airflow generator 26 flows through the airflow path 42 towards the exhaust vents 16.

In the embodiments shown in FIGS. 2, 3, 4, 5 and 8 to 11 it can be seen that the protrusion 56 of the snap-fit engagement means is located on an outer surface of the skirt 66.

As can be seen in FIG. 6*b* the first side edges 46 of the blades 44 are located at the edge 68 of the airflow path 42 and the second side edges 48 of the blades 44 are located near the exhaust vents 16. It can be seen that each blade 44 is curved along its length towards the exhaust vents 16. In this embodiment the blades 44 project from the downstream surface 40 of the planar body 36. The blades 44 thus form a plurality of passageways which curve away from the airflow passage 42 directing air towards the exhaust vents 16. The blades 44 decrease in thickness along their length from their first side edges 46 to their second side edges 48.

In the embodiments shown in FIGS. 2 to 7 the planer body 36 is substantially circular in shape with the blades 44 arranged around circumferentially about its downstream face 40. Of course the body 36 could be of any other suitable shape which would allow the blades 44 to be located on it. In these Figures it can be seen that the first 46 and second 48 side edges of adjacent blades 44 overlap, the overlapping edges 46, 48 spaced apart along a radius of the planar body 36. This allows air to pass between the blades 44 towards the exhaust vents 16 but blocks the line of sight between the airflow generator 26 and the exhaust vents 16. In the embodiment shown there are three blades 44. It is of course possible to have more or less than this. It is preferred that the first side edge 46 of each blade starts in line with the second side edge 48 of the adjacent blade 44. In this way the line of sight between the airflow generator 42 and the exhaust vents 16 is always blocked. The first side edge 46 of each blade can start before the second side edge 48 of the adjacent blade 44 such that they overlap. The distance between the blades 44 can vary although it is important that they do not provide too much of a restriction in terms of airflow through the vacuum cleaner 1.

In FIG. 6*b* it can be seen that the second side edges 48 of the blades 44 stop short of the outer edge of the body 36. It is possible to have the second side edges 48 extending right up to the outer edge but this is only desirable in embodiments where there is at least one exhaust vent 16 between such adjacent blades 44 otherwise the air path would be blocked for any air that traveled between such blades 44.

The edge 68 of the airflow path 42 can be seen in FIG. 6*b*. The size of the aperture is not critical although it is desirable for it to be larger than the size of the suction opening 4 of the vacuum cleaner 1 to prevent back pressure from building up. In a preferred embodiment the edge 68 of the airflow path is 1.5 times the size of the suction opening 4.

Figure 9:
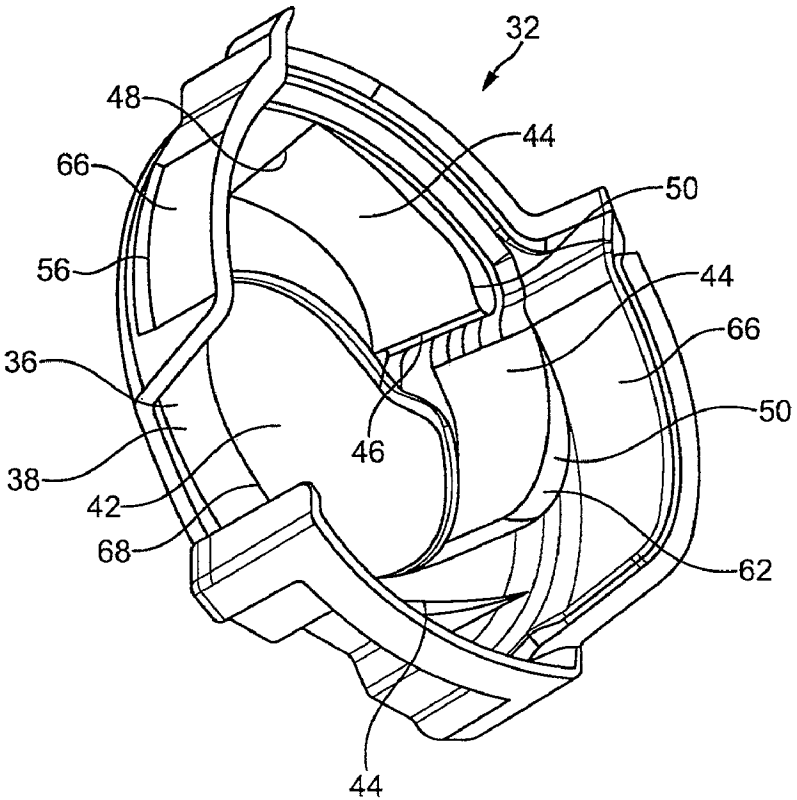
Figure 8:
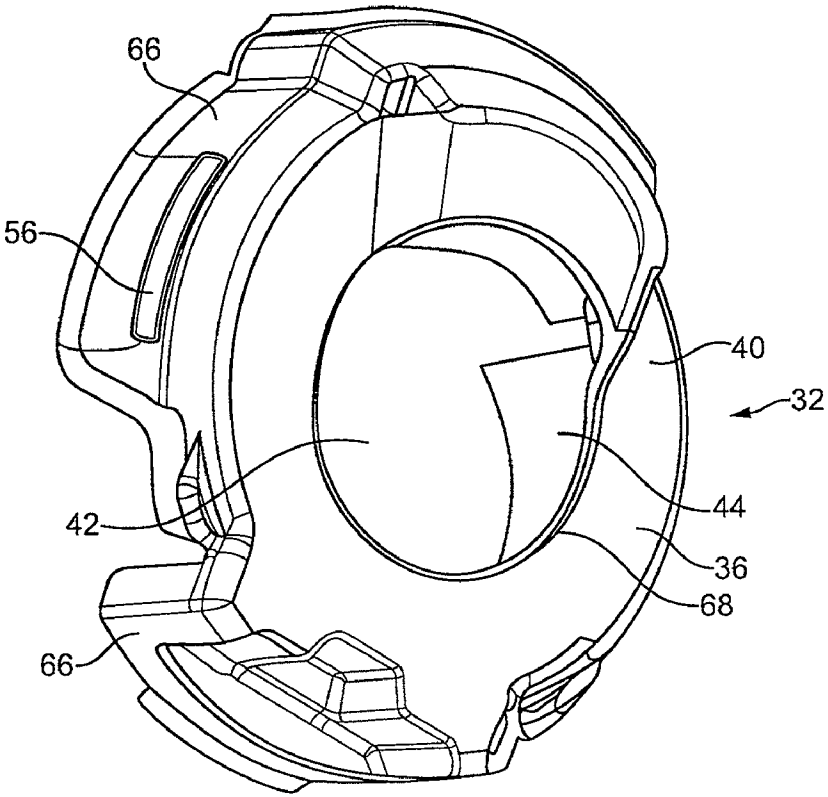
Figure 11:
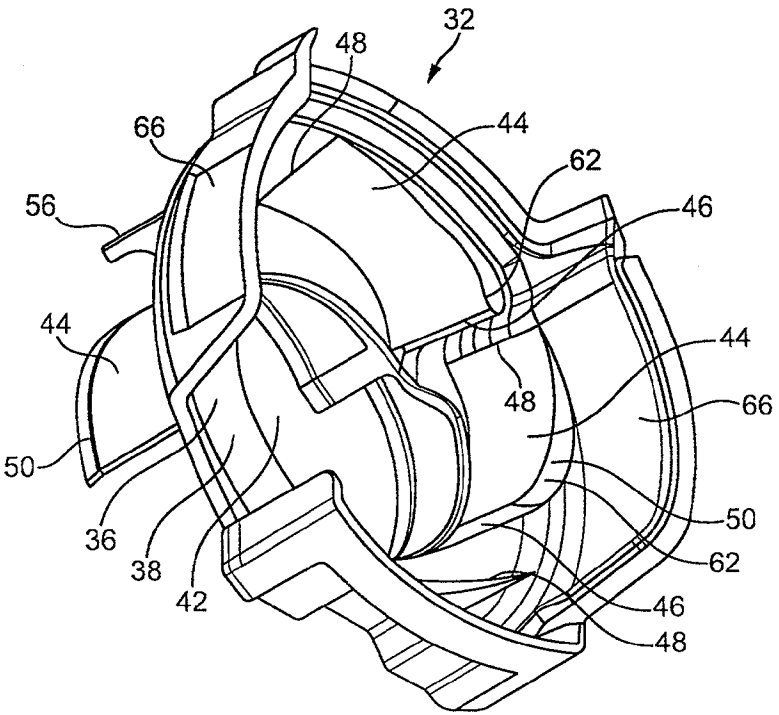
FIG. 10 and FIG. 11 are perspective views of an alternative embodiment of an exhaust baffle having a plurality of blades projecting from the upstream and the downstream face of the body in accordance with the second aspect of the present invention.
Figure 10:
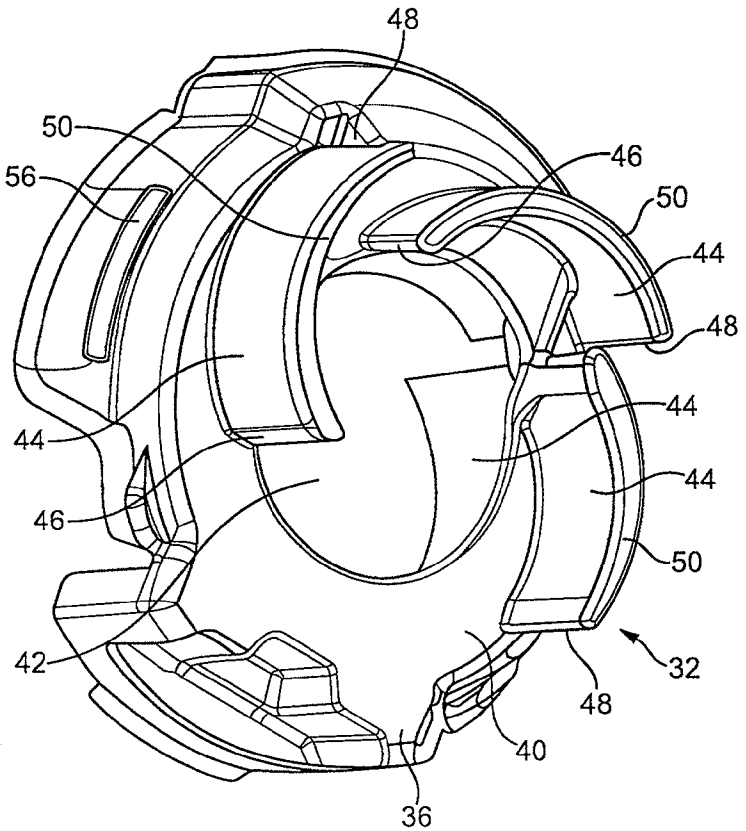

FIGS. 8 and 9 show perspective views of an alternative embodiment of an exhaust baffle 32 having a plurality of blades 44 projecting from the upstream face 38 of the planar body 36. FIGS. 10 and 11 show perspective views of an alternative embodiment of an exhaust baffle 32 having a plurality of blades 44 projecting from the upstream 36 and the downstream face 38 of the planar body 36.

In such embodiments it is also desirable that that there is an interface fit is provided between the forward edges 50 of the blades 44 and an inner surface 60 of the end face 54 of the casing 14, or with the airflow generator 26 or the housing 12 of the airflow generator 26. Again this may be achieved by having a groove 62, for example a V-shaped groove 62 on the forward edges 50 of the blades 44 and a corresponding projection on the appropriate part of the vacuum cleaner.

In embodiments which have blades 44 located on both faces 38, 40 of the planar body 36, or on the upstream face 38 only, other features may be as described in relation to the first embodiment.

Ideally the exhaust baffle 32 is designed to be as aerodynamic as possible. In order to achieve this, the surfaces are as smooth as possible.

The invention is not limited to the features of the specific embodiment described above. Variations will be apparent to the person skilled in the art.

The invention claimed is:

1. A cleaning appliance comprising an airflow generator for generating an airflow, a separating apparatus for separating dirt and dust from the airflow, a power source for supplying power to the airflow generator, at least one exhaust vent and an exhaust baffle, the exhaust baffle comprising a substantially planar body having an upstream face and a downstream face, an airflow path between the upstream and downstream faces and a plurality of blades projecting from the body, each blade having a first side edge, a second side edge and a forward edge and further comprising a skirt extending from an outer edge of the body so as to engage with the airflow generator, a casing or a housing of the airflow generator to provide an airtight or substantially airtight seal such that, during use, all or substantially all of the airflow exhausting from the airflow generator flows through the airflow path towards the at least one exhaust vent, wherein there is an interface fit between the forward edges of the blades and an inner surface of the casing.

2. The cleaning appliance according to claim 1 wherein the exhaust baffle is arranged downstream of the airflow generator and upstream of the at least one exhaust vent.

3. The cleaning appliance according to claim 1 wherein at least one of the blades blocks the line of sight between the airflow generator and at least one exhaust vent.

4. The cleaning appliance according to claim 1 wherein the casing comprises a removable casing of the cleaning appliance, at least one exhaust vent is located on the casing and the exhaust baffle is removably located at least partially within the casing.

5. The cleaning appliance according to claim 1 wherein the skirt extends from an outer edge of the upstream face of the body.

6. The cleaning appliance according to claim 1 wherein the blades project from the downstream face of the body.

* * * * *